US005089109A

United States Patent [19]

Suganuma et al.

[11] Patent Number: 5,089,109

[45] Date of Patent: Feb. 18, 1992

[54] ELECTRODE PROTECTOR

[75] Inventors: Yoshiaki Suganuma; Kuniaki Yamada, both of Kanagawa, Japan

[73] Assignee: Permelec Electrode Ltd., Kanagawa, Japan

[21] Appl. No.: 582,312

[22] Filed: Sep. 14, 1990

[30] Foreign Application Priority Data

Sep. 14, 1989 [JP] Japan ..... 1-236894

[51] Int. Cl.[5] ..... C25D 17/10; C25D 17/00

[52] U.S. Cl. ..... 204/290 R; 204/279; 204/280

[58] Field of Search ..... 204/279, 290 R, 290 F, 204/291, 292, 293, 295, 280, 282, 283

[56] References Cited

U.S. PATENT DOCUMENTS 4,394,244 7/1983 Divisek et al. ..... 204/295

FOREIGN PATENT DOCUMENTS 0030957 7/1983 Japan ..... 204/290 F

*Primary Examiner*—John Niebling
*Assistant Examiner*—Kathryn Gorgos
*Attorney, Agent, or Firm*—Sughrue, Mion, Zinn, Macpeak & Seas

[57] ABSTRACT

An electrode protector, which is to be attached to the surface of an insoluble metal electrode for use as the counterpart electrode in a continuous electrolytic treatment of a metal strip or the like and serves to prevent short circuiting, comprising a mesh substrate made of a corrosion-resistant metal, and provided on the surface of the mesh substrate, a corrosion-resistant electrically insulating coating.

6 Claims, No Drawings

ELECTRODE PROTECTOR

FIELD OF THE INVENTION

The present invention relates to an electrode protector. More particularly, it relates to an electrode protector for an insoluble electrode used as the counterelectrode in the continuous electrolytic treatment of metal strips or the like.

BACKGROUND OF THE INVENTION

In conventional electrolytic treatments typically including the continuous plating or acid cleaning of strips of steel plate, semi-expendable or insoluble electrodes such as ferrosilicon, lead, lead alloys, or the like have been used as the counterelectrode as disclosed in, for example, JP-B-53-18167 (the term "JP-B" as used herein means an "examined Japanese patent publication"). For example, in an electrolytic zinc-plating line, a steel plate is used as the cathode and a lead alloy is used as the counter anode, and the steel plate is advanced at a line speed as high as 1 to 2 m/sec, while the end of the steel plate is usually oscillating perpendicularly to the line direction. Furthermore, the distance between the steel plate and its counterelectrode is extremely short, i.e., about 10 mm on average, for the purposes of stable operation, cost saving, etc. Because of such electrolytic plating lines, there have often been cases where the steel plate being treated comes into contact with the counterelectrode to cause shortcircuiting. In the case of lead alloy electrodes, the shortcircuiting problem has not been so urgent because the lead alloy has a nature that even if it fuses due to the heat generated at the time of shortcircuiting, the fused part of the lead alloy immediately absorbs the heat as heat of fusion and returns to its solid state. However, the lead alloy electrode is defective in that the amount of lead dissolved from the electrode into the electrolyte during electrolysis is as relatively large as 1 to 10 mg/AH, and the dissolved lead comes into the resulting platings on the products. For this reason, use of insoluble metal electrodes has come to be studied, which comprise substrates made of valve metals such as titanium, having formed over the substrate surfaces coatings containing platinum group metals or oxides thereof as disclosed in, for example, JP-A-56-47597 (the term "JP-A" as used herein means an "unexamined published Japanese patent application"). This kind of electrode is characterized in that the erosion of the coating is very slow, i.e., about 1/10 to 1/100 of the lead electrodes, and they are substantially insoluble and dimensionally stable. Therefore, the insoluble metal electrodes are coming to be used extensively.

However, use of such a metal substrate electrode has a problem that if shortcircuiting as described above occurs, not only the coating but also the substrate is damaged. In order to prevent shortcircuiting, the material being treated such as steel plate has conventionally been prevented from coming into direct contact with the electrode surface by, for example, placing a net of fluoroplastic or other plastic or a plate of resin or ceramic on the surface of the electrode. However, if an edge of the steel plate etc. which is traveling at a high speed hits such a net, the net is cut too easily to be practically used. Although plates may retain their physical strength, use of plates is defective in that the electrode surface is masked to substantially limit the effective area of the electrode because the plate has a large area so as to protect the whole electrode surface, and this leads to a problem that the life of the electrode is shortened and unevenness of treatment results.

The above problems apply to electrolytic acid cleaning and similar treatments. Those problems have been severe particularly in high-speed treatments.

SUMMARY OF THE INVENTION

An object of the present invention is to provide an electrode protector which, when attached to the surface of an insoluble electrode for use in the continuous electrolytic treatment of metal strips or the like, masks only a limited area of the electrode surface and shows sufficient strength to effectively prevent shortcircuiting that may be caused by contact with the material being treated, thereby overcoming the problems described above.

DETAILED DESCRIPTION OF THE INVENTION

As described above, an electrode protector, which is to be attached to the surface of an insoluble metal electrode for use as the counterpart electrode in a continuous electrolytic treatment of a metal strip or the like and serves to prevent shortcircuiting, should have sufficient insulating properties and strength and, at the same time, is required not to mask the whole electrode surface. It has been found that these requirements can be satisfied and the above-described object of the present invention is fully accomplished by an electrode protector for insoluble electrodes which comprises a mesh substrate made of a corrosion-resistant metal and, provided on the surfaces of the mesh substrate, a corrosion-resistant electrically insulating coating.

Accordingly, a metal mesh having a sufficient percentage of openings is employed as the substrate in the electrode protector of the present invention. Specifically, an expanded metal mesh is particularly preferred, which is normally produced by cutting and stretching sheet metal. However, metal meshes of other similar structures can also be employed, such as those made by weaving or knitting metal wires which may have electrically insulating coatings before weaving or knitting. Since such a metal mesh has many open spaces and its surface is not even, passageways for the electrolyte and evolved gas are ensured after attachment of the metal mesh to the electrode surface, and the masked area of the electrode active surface can be made small with the area in contact with the mesh being minimal. A slightly rolled expanded mesh (i.e., the thickness of the mesh becomes about 50% or more of the apparent thickness of the expanded mesh) can be used, whereas an expanded mesh that has been heavily rolled (i.e., the thickness of the mesh becomes about 50% or less of the apparent thickness of the expanded mesh) and has a large proportion of flat surface area is not preferable because the area in contact with the electrode surface becomes large.

The metal mesh can be made to have a shape and size suitable to the electrode to which the metal mesh is to be attached. In general, however, the thickness of the mesh is preferably 5 mm or less from the standpoint of securing passageways for electrolyte, etc. and the distance from materials to be treated. The percentage of openings in the metal mesh is desirably 70% or more, preferably 85 to 90%, in order to reduce the area of the masked part in the electrode surface. The material for the metal mesh is suitably selected from metals having sufficient strength and corrosion resistance. Nickel and steel are suitable for use in alkali solutions, while titanium and titanium alloys as well as other valve metals can be used in either acid or alkali solutions.

On the surfaces of the metal mesh substrate, a corrosion-resistant insulating coating is formed to ensure the electrical insulating properties of the electrode protector as a shortcircuiting-preventive protector.

As the material for such a corrosion-resistant insulating coating, any of various kinds materials having insulating properties and physical and chemical strengths can be used. Preferred examples thereof include oxides of valve metals such as titanium, tantalum, zirconium, niobium, etc.; and oxides of aluminum, magnesium, silicon, etc. and oxide-type ceramics containing these elements. In addition, materials containing carbides, nitrides, or the like may also be suitably used. A coating of such a material can be formed over the metal mesh substrate by a suitable technique such as the coating-baking method or the flame spray coating method.

The electrode protector thus obtained is attached to the surface of an insoluble electrode by a suitable means such as, bolting, thereby giving an electrode structure. The electrode structure thus assembled is used in the continuous electrolytic treatment of strips of metal or in other similar electrolytic treatments.

The electrode protector of the present invention, which has a structure comprising a corrosion-resistant metal mesh substrate and a corrosion-resistant electrically insulating coating formed over the surfaces of the substrate, has sufficient insulating properties and strength and, when used in electrolytic treatment after being attached to the surface of an insoluble electrode, can effectively prevent shortcircuiting that may be caused by contact between the electrode and the material being treated. Thus, the electrolytic treatment can be run safely for a prolonged period of time. Furthermore, since the electrode protector of the present invention has a sufficient percentage of openings, the masked area in the electrode surface to which the protector has been attached can be made minimal, passageways for gas and liquid can be fully ensured, and the electrode can be prevented from having a shortened life that may result from unevenness in electric current distribution.

The present invention will be explained below in more detail by reference to the following Examples, which should not be construed to be limiting the scope of the invention.

EXAMPLE 1

An electrode protector was tightly attached by means of titanium bolts to the surfaces of twelve insoluble metal electrodes each of which had a width of 30 cm and a length of 50 cm and which had been attached to a current-supply board in a high-speed, continuous zinc-plating line for steel plates.

The electrode protector used above was an expanded mesh substrate which had been formed from a titanium plate 1 mm thick and which had mesh opening sizes of LW=50 mm and SW= 35 mm and a percentage of openings of 72%. Since the mesh was used without being rolled, only 10% or less of the electrode surface was substantially masked by the electrode protector. The surface of the titanium mesh was then covered with a coating of $\alpha$-alumina to a thickness of about 100 $\mu$m by the flame spray coating technique, thereby forming a corrosion-resistant electrically insulating coating.

The above-described high-speed zinc-plating line was actually run for about 6 months using the electrode structure consisting of the insoluble metal electrodes and the above-described electrode protector attached thereto. As a result, it was found that although part of the protector mesh had been cut by contact with the steel plates during the continuous run, the electrode surface was completely free of damage such as those caused by shortcircuiting and had been safely protected.

EXAMPLE 2

An electrode protector having a thickness of about 3.5 mm and a percentage of openings of about 90% was obtained by applying a coating paste containing titanium oxide and silicon oxide to a thickness of about 0.2 mm on a substrate which was a mesh prepared by knitting titanium wires with a diameter of 1 mm, and heating and calcining the applied paste at 700° C. to form an insulating coating. The thus-obtained electrode protector was attached to an electrode surface in the same manner as in Example 1, and the resulting electrode structure was used as a current-supply positive electrode in an electrolytic, acid-cleaning continuous line for stainless steel. During a continuous run for about 2 years, collisions took place between the protector mesh and the material being treated. When part of the mesh suffered damage due to the collisions, it was replaced with a new one. When the coating on other parts of the mesh peeled off due to the collisions and the titanium substrate was exposed, the electrolytic acid cleaning was continued with the exposed area being left as it was. As a result, the electrolytic acid cleaning can be run without any problem, the electrode surface suffered no damages, and there was no unevenness in electric current distribution.

While the invention has been described in detail and with reference to specific embodiments thereof, it will be apparent to one skilled in the art that various changes and modifications can be made therein without departing from the spirit and scope thereof.

What is claimed is:

1. An electrically insulated electrode protector for an insoluble electrode, comprising a corrosion-resistant metal mesh substrate having provided thereon a corrosion-resistant electrically insulating material, said metal mesh being of open texture and having pores over the surface thereof.

2. An electrode protector as claimed in claim 1, wherein said corrosion-resistant metal is titanium or a titanium alloy.

3. An electrode protector as claimed in claim 1, wherein the percentage of openings in said mesh comprises 70% or more of the surface area.

4. An electrode protector as claimed in claim 1, wherein said corrosion-resistant electrically insulating coating is a ceramic coating.

5. An electrode protector as claimed in claim 1, wherein said electrode protector is in a shape substantially corresponding to at least a part of the surface of said insoluble electrode, and is provided on said part of said surface of said insoluble electrode in a manner to protect said insoluble electrode from contact with a counter electrode.

6. An electrode structure which comprises an insoluble electrode and an electrically insulating electrode protector attached to the surface of the electrode, said electrode protector comprising a mesh substrate made of a corrosion-resistant metal and, provided on the surfaces of the mesh substrate, a corrosion-resistant electrically insulating coating.

* * * * *